US009543089B2

(12) United States Patent
Kirita

(10) Patent No.: US 9,543,089 B2
(45) Date of Patent: Jan. 10, 2017

(54) SWITCH DEVICE

(71) Applicant: U-SHIN LTD., Tokyo (JP)

(72) Inventor: Toshinori Kirita, Kure (JP)

(73) Assignee: U-Shin Ltd., Tokyo (JP)

( * ) Notice: Subject to any disclaimer, the term of this patent is extended or adjusted under 35 U.S.C. 154(b) by 0 days.

(21) Appl. No.: 14/415,861

(22) PCT Filed: Jul. 12, 2013

(86) PCT No.: PCT/JP2013/069196

§ 371 (c)(1),
(2) Date: Jan. 20, 2015

(87) PCT Pub. No.: WO2014/017325

PCT Pub. Date: Jan. 30, 2014

(65) Prior Publication Data

US 2015/0170850 A1 Jun. 18, 2015

(30) Foreign Application Priority Data

Jul. 25, 2012 (JP) ..... 2012-164575

(51) Int. Cl.
*H01H 9/02* (2006.01)
*H01H 13/02* (2006.01)
(Continued)

(52) U.S. Cl.
CPC ..... *H01H 13/023* (2013.01); *H01H 13/52* (2013.01); *H01H 13/83* (2013.01);
(Continued)

(58) Field of Classification Search
CPC ..... H01H 2231/026; H01H 2300/032; H01H 27/00; H01H 9/0271
(Continued)

(56) References Cited

U.S. PATENT DOCUMENTS 6,777,633 B2 * 8/2004 Kondo ..... H01H 25/041 200/310
8,810,363 B2 * 8/2014 Sakamoto ..... B60R 25/04 180/279
(Continued)

FOREIGN PATENT DOCUMENTS

JP 6-40246 5/1994
JP 2004-314806 11/2004
(Continued)

OTHER PUBLICATIONS

International Preliminary Report on Patentability and Written Opinion of the International Searching Authority issued Feb. 5, 2015 in International (PCT) Application No. PCT/JP2013/069196.
(Continued)

*Primary Examiner* — Renee Luebke
*Assistant Examiner* — Ahmed Saeed
(74) *Attorney, Agent, or Firm* — Wenderoth, Lind & Ponack, L.L.P.

(57) ABSTRACT

A switching device includes a holder, an operation knob, a ring-like antenna, and a circuit board on which wire connecting the antenna to an external circuit and a detection means (switching portion) for detecting an operation of the knob are disposed. A light source for illuminating a display on the knob is disposed on the circuit board. A transparent lens member disposed on an outer periphery of the knob transmits a light from the light source so as to illuminate the outer periphery of the knob. A slider with a light guide path for a LED is accommodated in the holder so as to be movable forward and rearward integrally with the operation. The antenna is integral with the lens member. The knob and the slider are disposed in a center hole of the lens member.

3 Claims, 9 Drawing Sheets

(51) Int. Cl.
*H01H 13/52* (2006.01)
*H01H 13/83* (2006.01)

(52) U.S. Cl.
CPC . *H01H 2219/036* (2013.01); *H01H 2219/062* (2013.01); *H01H 2219/066* (2013.01); *H01H 2219/0622* (2013.01)

(58) Field of Classification Search
USPC ..... 307/10.5, 10.6; 200/52 R, 310–314, 341, 200/345
See application file for complete search history.

(56) References Cited

U.S. PATENT DOCUMENTS

| | | | | |
|---|---|---|---|---|
| 9,105,413 | B2 * | 8/2015 | Hiranuma | H01H 9/20 |
| 2004/0129041 | A1 | 7/2004 | Shigeyama et al. | |
| 2004/0206610 | A1 | 10/2004 | Hasegawa et al. | |
| 2009/0115250 | A1 * | 5/2009 | Kim | H01H 27/08 307/10.5 |
| 2010/0206705 | A1 * | 8/2010 | Yamamoto | H01H 13/54 200/341 |
| 2011/0121925 | A1 | 5/2011 | Emmerling et al. | |
| 2012/0075063 | A1 * | 3/2012 | Sakamoto | B60R 25/04 340/5.62 |
| 2012/0140457 | A1 * | 6/2012 | McQuade | H01H 9/04 362/184 |
| 2012/0199461 | A1 * | 8/2012 | Shim | B60R 25/00 200/52 R |
| 2015/0179366 | A1 * | 6/2015 | Kirita | F02N 11/0807 200/314 |

FOREIGN PATENT DOCUMENTS

| | | |
|---|---|---|
| JP | 2007-303171 | 11/2007 |
| JP | 2010-192149 | 9/2010 |
| JP | 4705317 | 6/2011 |
| JP | 2011-525455 | 9/2011 |
| KR | 20-2011-0004420 | 5/2011 |

OTHER PUBLICATIONS

International Search Report issued Oct. 8, 2013 in International (PCT) Application No. PCT/JP2013/069196.

* cited by examiner

SWITCH DEVICE

This is a national phase application in the United States of International Patent Application No. PCT/JP2013/069196 with an international filing date of Jul. 12, 2013, which claims priority of Japanese Patent Application No. 2012-164575 filed on Jul. 25, 2012 the contents of which are incorporated herein by reference.

TECHNICAL FIELD

The present invention relates to a switch device such as an engine start/stop switch mounted on an instrument panel of a vehicle.

BACKGROUND ART

Some recent vehicles are equipped with a smart ignition system that enables engine to start in response to an ID signal wirelessly transmitted from mobile equipment. With the smart ignition system, when the user operates an engine start/stop switch mounted on an in-vehicle instrument panel, a vehicle authentication device transmits a request signal to the mobile equipment. Upon receipt of the request signal, the mobile equipment transmits an own ID signal to the vehicle authentication device. The vehicle authentication device compares an ID code included in the received ID signal with a previously stored ID code, and if both the ID codes match, authenticates the ID code, and enables the engine to start to activate the engine by operating the engine start/stop switch.

Some smart ignition systems have a transponder communication function of communicating with the vehicle authentication device without requiring a power source such as a battery in the mobile equipment, as an auxiliary communication means used when the battery or the like in the mobile equipment becomes exhausted, leading to an uncommunicable state. In the transponder communication function, when the mobile equipment receives starting radio waves transmitted from a coil antenna in the vehicle authentication device, a coil part of a transponder in the mobile equipment generates an electromotive force, and an ID signal is transmitted to the vehicle authentication device by the electromotive force to achieve communication between the vehicle authentication device and the mobile equipment.

The use of the transponder communication function requires the user to operate the engine start/stop switch in the state where the mobile equipment is located near the coil antenna of the vehicle. In order to facilitate the user to recognize the location of the coil antenna, the coil antenna is disposed in the vicinity of the engine start/stop switch.

Regarding the arrangement of the coil antenna, for example, Japanese Patent Publication No. 4705317 proposes that a coil antenna 119 is disposed on the radial outer side of an operation knob 103 of a switch device (engine start/stop switch) 101 as shown in a cutaway side view of FIG. 11. Japanese Unexamined Patent Application Publication No. 2011-525455 proposes that a coil antenna 219 is disposed along the inner edge of an operation knob 203 as shown in a side sectional view of FIG. 12.

SUMMARY OF THE INVENTION

Problems to be Solved by the Invention

In a switch device such as an engine start/stop switch provided with a coil antenna, to illuminate the outer periphery of an operation knob in a ring form, it is need to dispose the coil antenna in a position other than the ring-like illuminated site. Thus, in locating indicator illumination for indicating an operational position on the outer periphery of the operation knob 103 in the configuration shown in FIG. 11 proposed in Patent Document 1, the indicator illumination needs to be disposed on the outer side of a coil antenna 119. This disadvantageously leads to an increase in the outer dimension of a switch device 101.

In the configuration shown in FIG. 12 proposed in Patent Document 2, because a coil antenna 219 is disposed along the inner periphery of an operation knob 203, the operation knob 203 has to be made larger than the coil antenna 219, disadvantageously increasing the outer dimension of a switch device 201.

In consideration of the above-mentioned circumstances, an object of the present invention is to provide a switch device capable of illuminating an operation knob in a ring form without leading to upsizing.

Means for Solving the Problems

To attain the object, according to a first aspect of the present invention, a switch device includes, a holder, an operation knob with a display, the operation knob held in the holder so as to be movable forward and rearward, a ring-like coil antenna that transmits starting radio waves for activating external mobile equipment, and a circuit board on which a wire for connecting the coil antenna to an external electric circuit and a detection means for detecting the operation of the operation knob are disposed. A light source for illuminating the display on the operation knob is disposed on the circuit board. An optically transparent lens is disposed on an outer periphery of the operation knob and transmits a light from the light source so as to illuminate the outer periphery of the operation knob. A slider is accommodated in the holder so as to be movable forward and rearward integrally with the operation knob and has a light guide path for the light source. The coil antenna is integral with the lens member, and the operation knob and the slider are disposed in a center hole of the lens member.

According to a second aspect of the present invention, a first ring part that accommodates the coil antenna and a second ring part that illuminates the outer periphery of the operation knob in a ring form are formed on a front face side of the lens member where the operation knob is disposed, and a cylindrical light guide part opposed to the light source is formed on a rear face side of the lens member.

According to a third aspect of the present invention, a center axis of the first ring part of the lens member is offset from a center axis of the second ring part in the vertical direction, the slider has a through hole into which the first ring part of the lens member is partially inserted, and a center axis of the coil antenna is offset from an operating center axis of the operation knob in the vertical direction.

According to a fourth aspect of the present invention, one side of an outer periphery of the first ring part of the lens member in the radial direction is disposed on an outer side of an outer periphery of the operation knob, and the other side of the outer periphery of the first ring part is disposed on an inner side of the outer periphery of the operation knob.

According to the first and second aspects, because the coil antenna is integrated with the optically transparent lens member, the opaque part caused by the coil antenna can be reduced, suppressing the influence on ring illumination for lighting the outer periphery of the operation knob. This can achieve ring illumination of the operation knob without increasing the size of the switch device.

According to the third aspect, to prevent interference between the slider and the coil antenna to allow forward and rearward movement of the slider, the coil antenna is partially inserted into the through hole in the slider. Such effective use of the through hole as a dead space enables strategic arrangement of the coil antenna, making the switch device compact.

According to the fourth aspect, by offsetting the first ring part such that the one side of the outer periphery of the first ring part in the radial direction of the lens member, which requires a predetermined space, is located on the outer side of the outer periphery of the operation knob, a high degree of flexibility in illumination for the display on the operation knob can be ensured without increasing the outer dimension of the coil antenna.

BRIEF DESCRIPTION OF THE DRAWINGS

The foregoing and the other features of the present invention will become apparent from the following description and drawings of an illustrative embodiment of the invention in which.

MODE FOR CARRYING OUT THE INVENTION

An embodiment of the present invention will be described below with reference to appended drawings.

Figure 1:
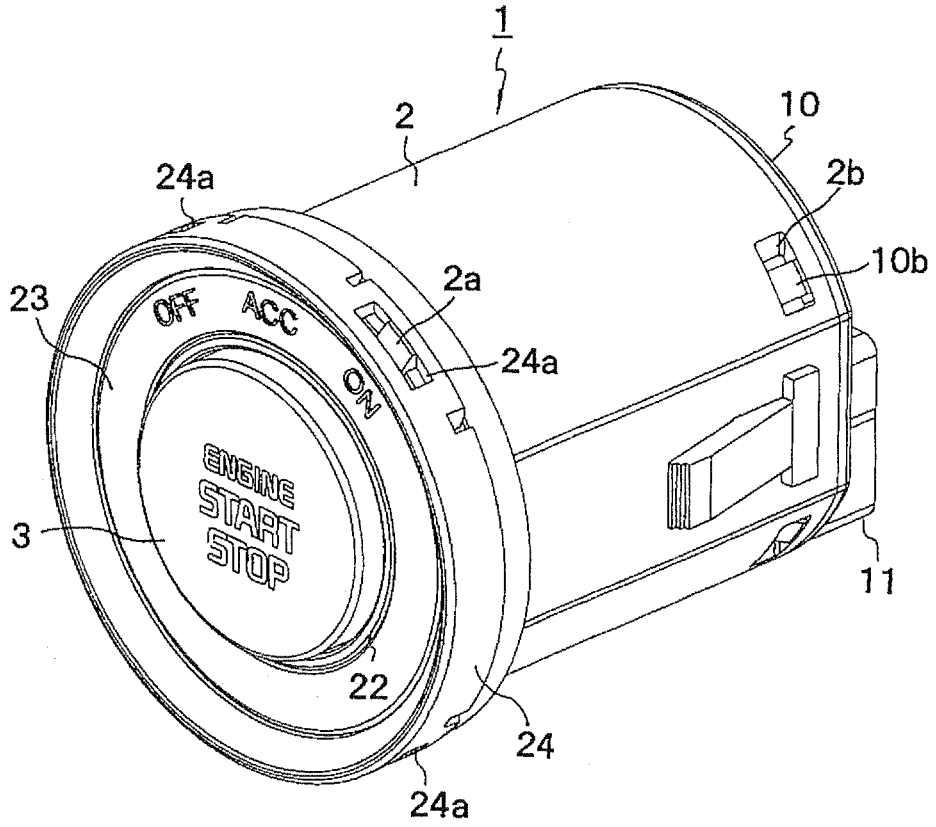
FIG. 1 is a perspective view illustrating a switch device according to the present invention.
Figure 2:
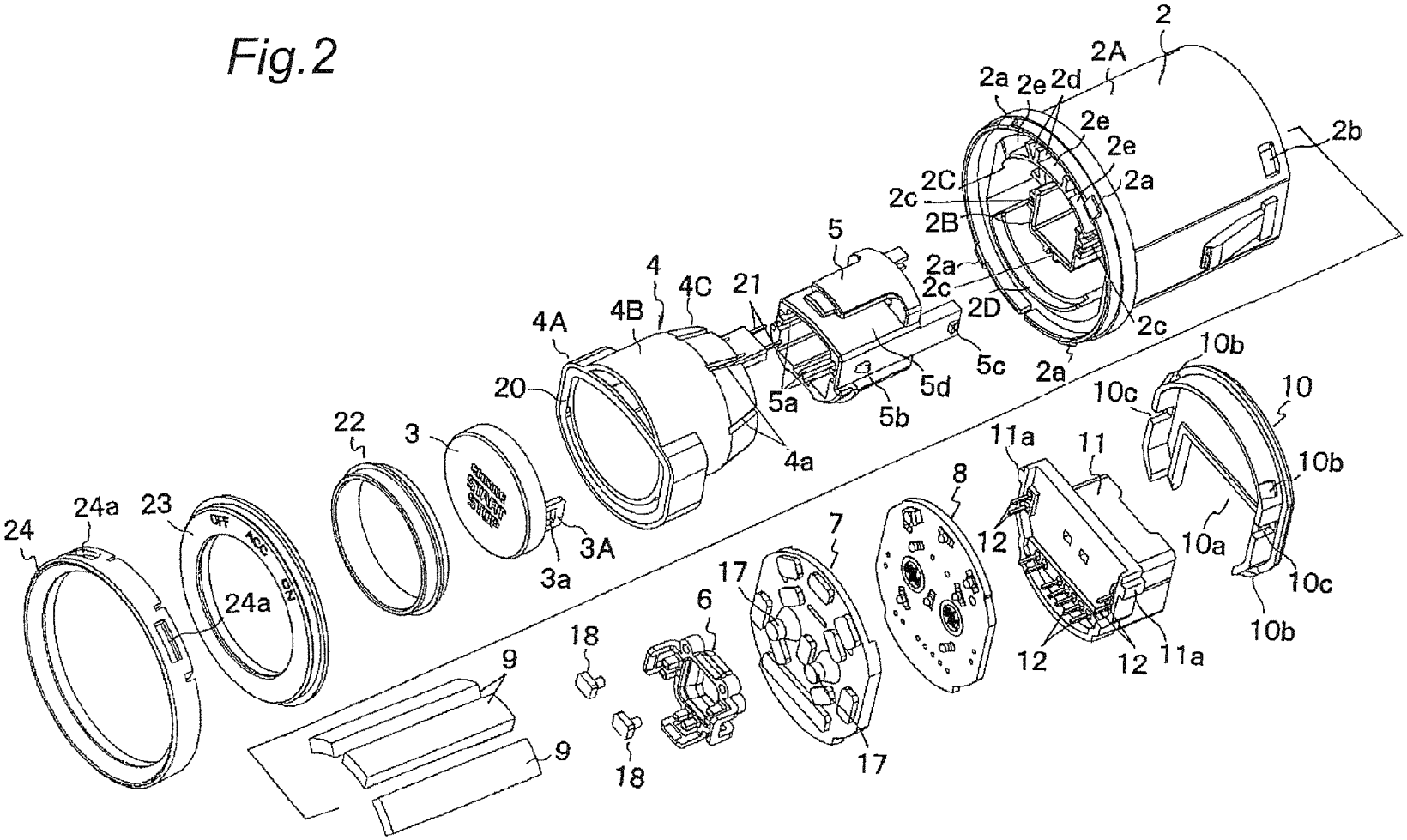
FIG. 2 is an exploded perspective view illustrating the switch device according to the present invention.
Figure 3:
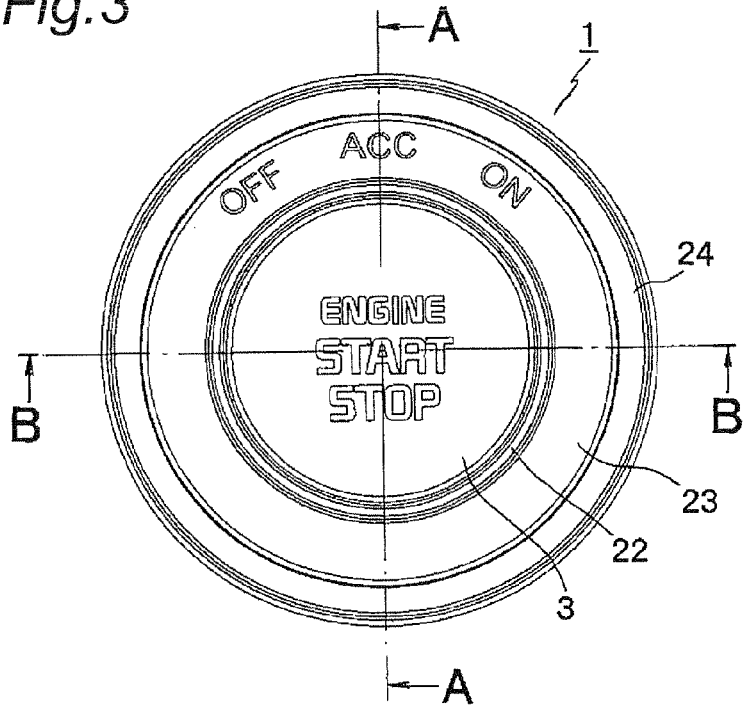
FIG. 3 is a front view illustrating the switch device according to the present invention.
Figure 4:
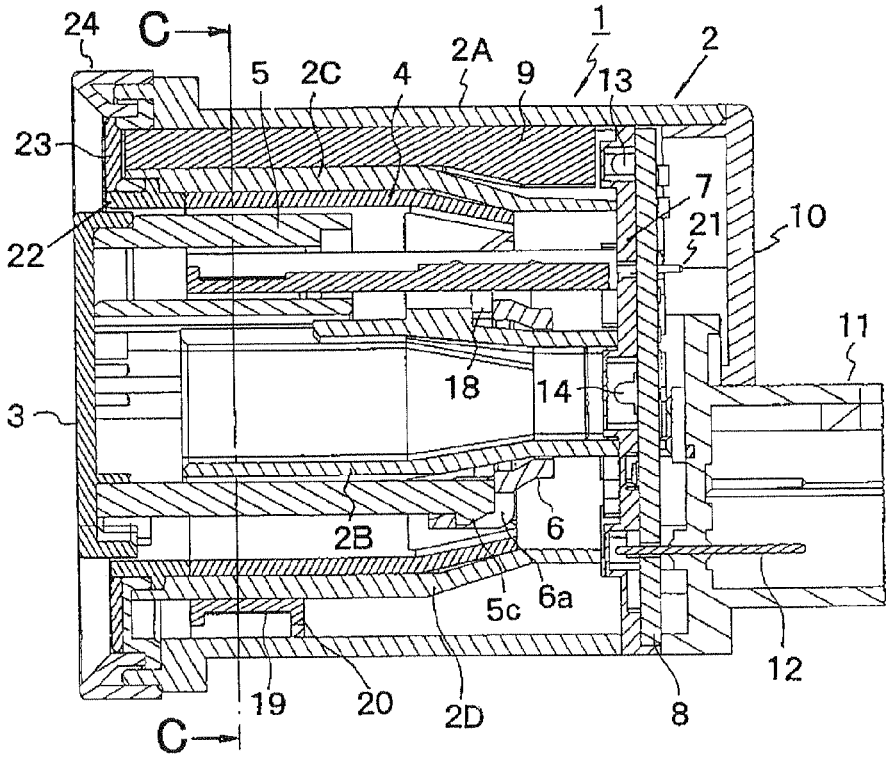
FIG. 4 is a sectional view taken along a line A-A in FIG. 3.
Figure 5:
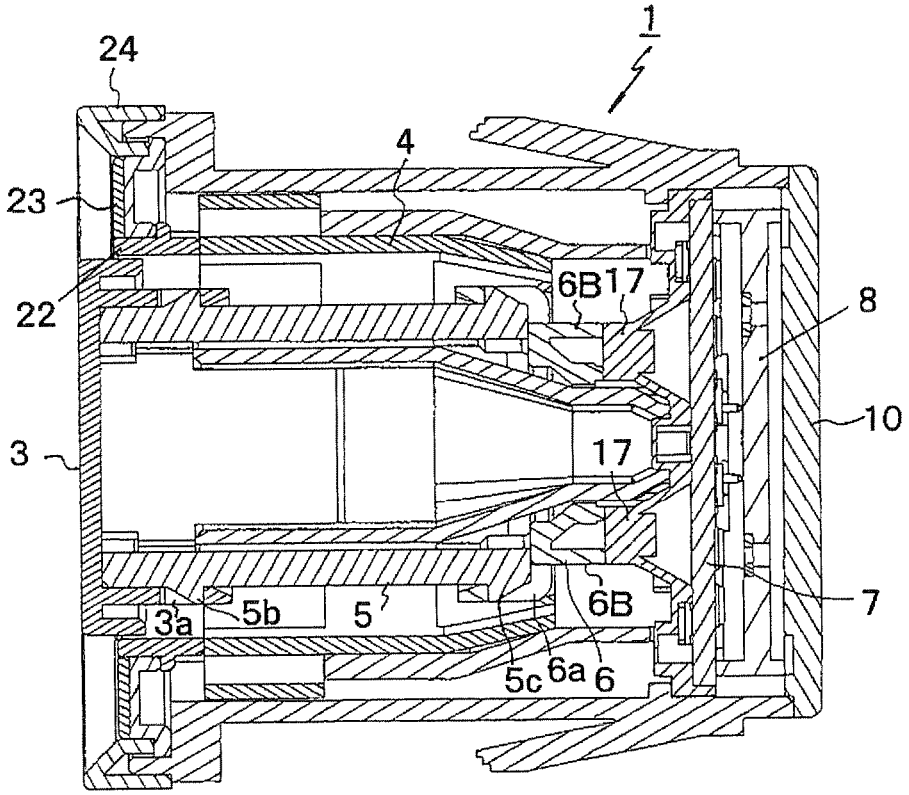
FIG. 5 is a sectional view taken along a line B-B in FIG. 3.
Figure 6:
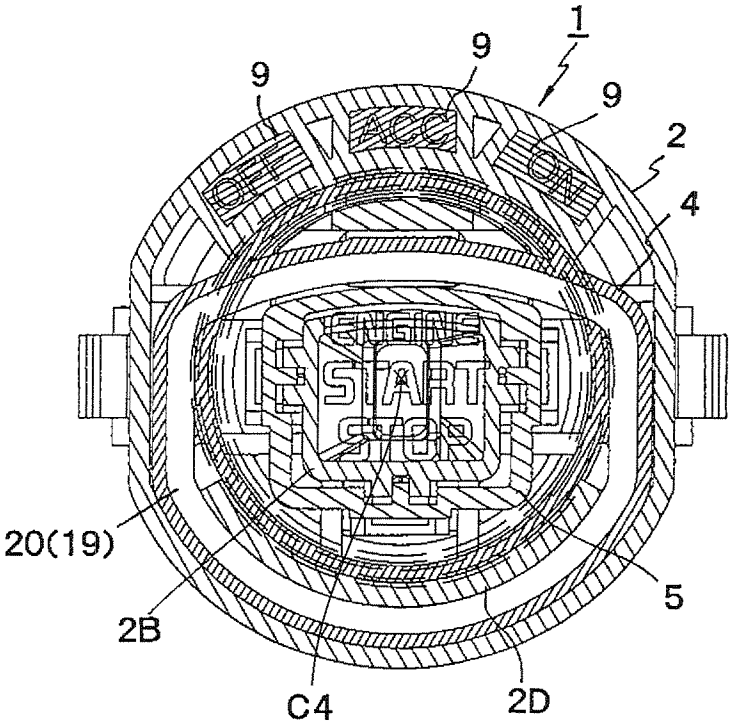
FIGS. 6(*a*) and 6(*b*) are sectional views taken along a line C-C in FIG. 4.
Figure 6:
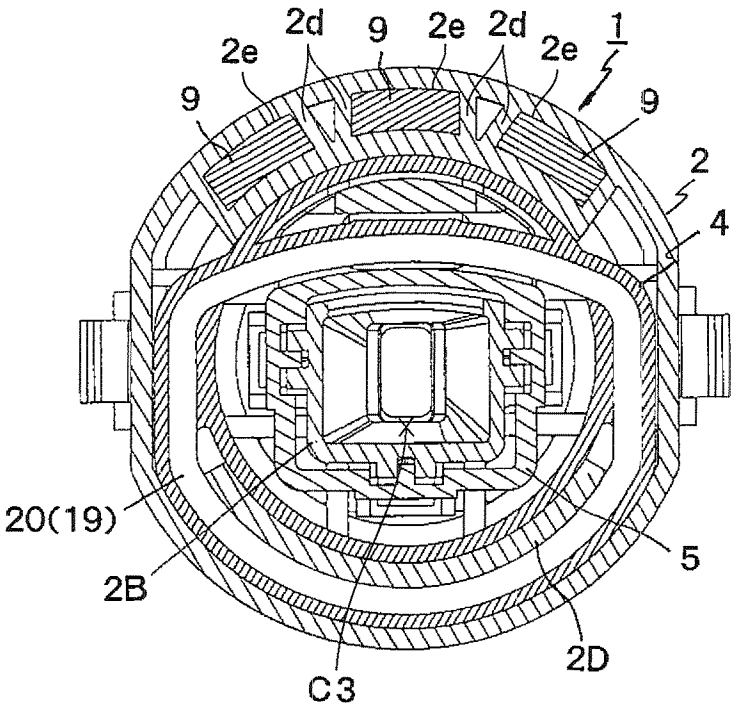
Figure 7:
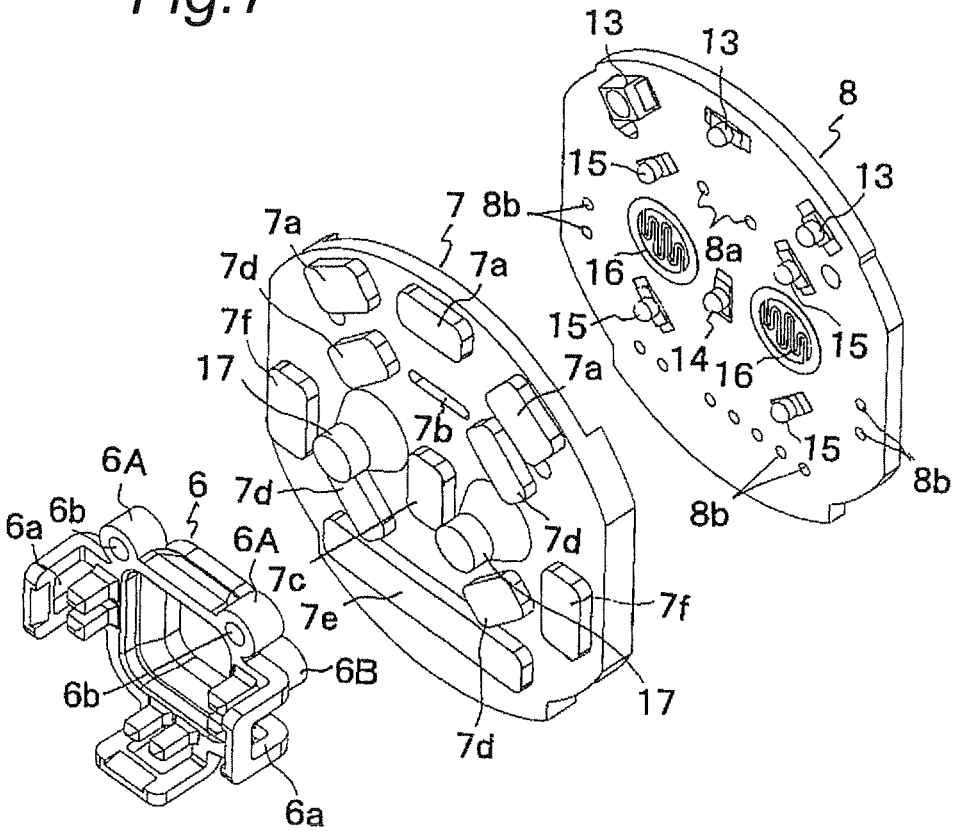
FIG. 7 is a perspective view illustrating a second slider, a rubber contact, and a circuit board of the switch device according to the present invention.
Figure 8:
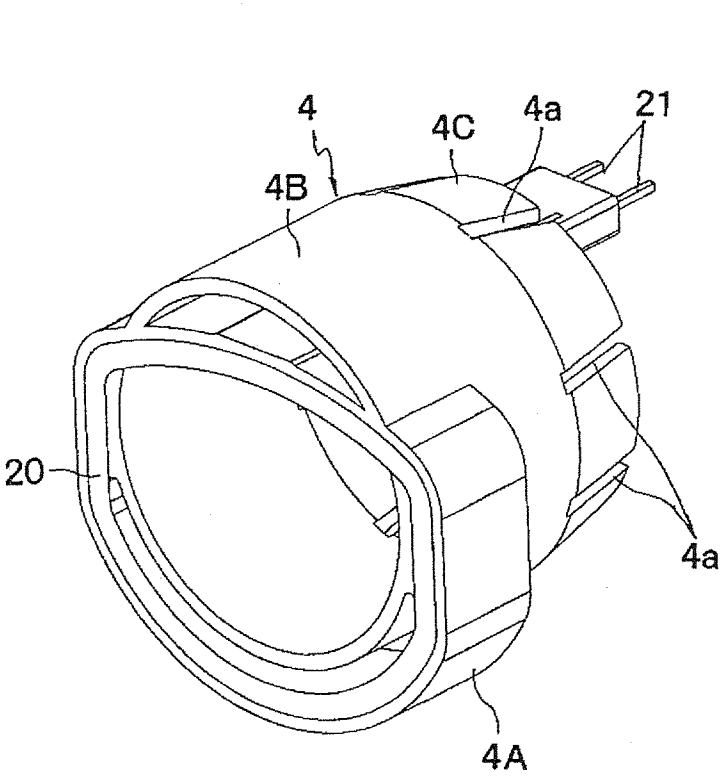
FIG. 8 is a perspective view illustrating a lens member and a coil antenna incorporated into the lens member of the switch device according to the present invention.
Figure 8:
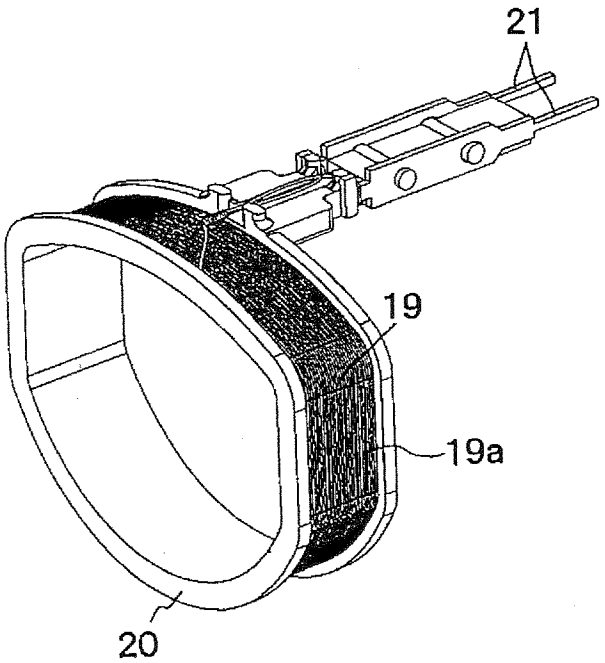
Figure 9:
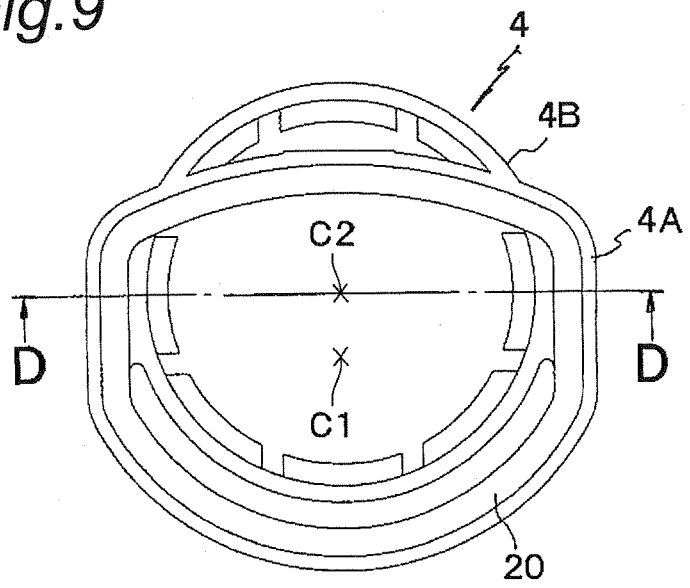
FIG. 9 is a front view illustrating the lens member of the switch device according to the present invention.
Figure 10:
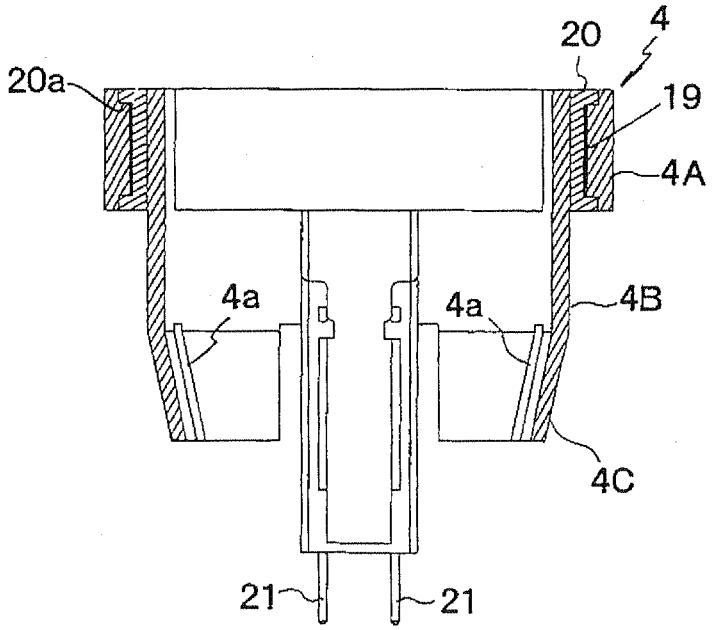
FIG. 10 is a sectional view taken along a line D-D in FIG. 9.
Figure 11:
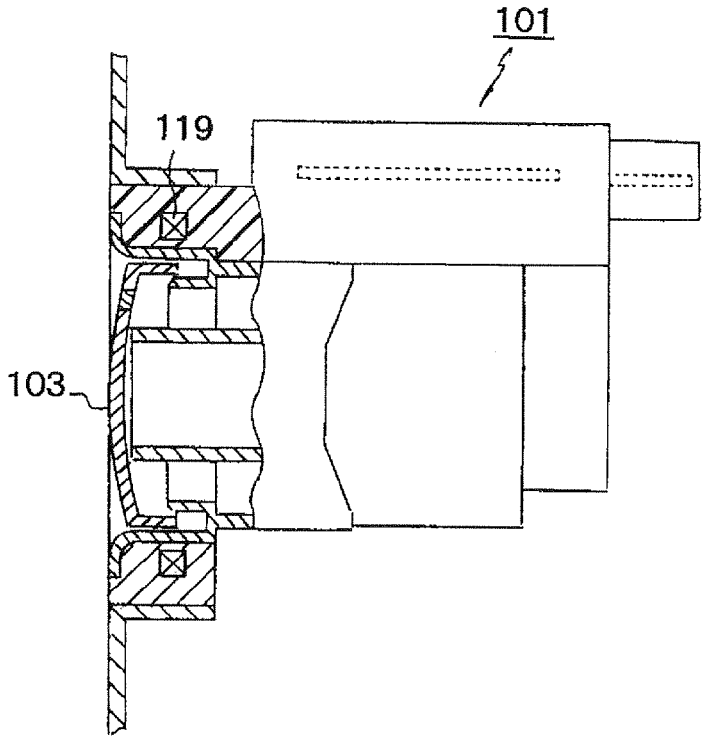
Fig.11 PRIOR ART
FIG. 11 is a cutaway side view illustrating a switch device proposed in Patent Document 1.
Figure 12:
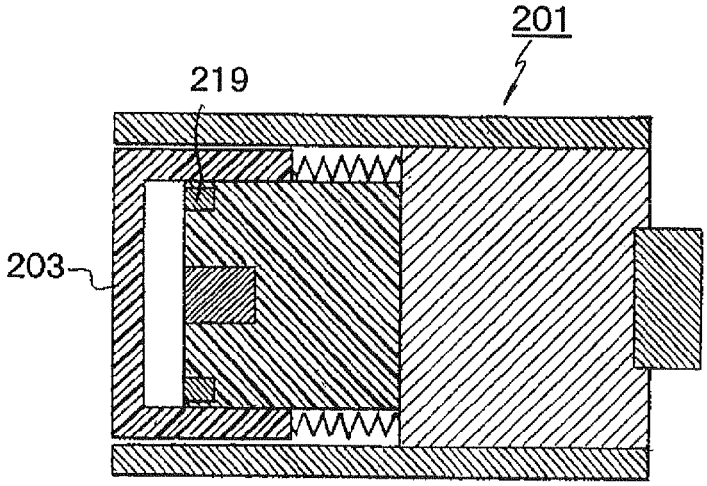
Fig.12 PRIOR ART
FIG. 12 is a side sectional view illustrating a switch device proposed in Patent Document 2.

FIG. 1 is a perspective view illustrating a switch device according to the present invention, FIG. 2 is an exploded perspective view illustrating the switch device, FIG. 3 is a front view illustrating the switch device, FIG. 4 is a sectional view taken along a line A-A in FIG. 3, FIG. 5 is a sectional view taken along a line B-B in FIG. 3, FIGS. 6(*a*) and 6(*b*) are sectional views taken along a line C-C in FIG. 4, FIG. 7 is a perspective view of a second slider, a rubber contact, and a circuit board, FIG. 8 is a perspective view illustrating a lens member and a coil antenna incorporated into the lens member, FIG. 9 is a front view illustrating the lens member, and FIG. 10 is a sectional view taken along a line D-D in FIG. 9.

The switch device 1 in accordance with this embodiment is an engine start/stop switch mounted on an instrument panel of a vehicle provided with a smart ignition system, and as shown in FIG. 4 and FIG. 5, an operation knob 3, a lens member 4, a slider 5, a second slider 6, a rubber contact 7, and a circuit board 8 are incorporated into a substantially cylindrical holder 2. The holder 2, the operation knob 3, the lens member 4, the slider 5, the second slider 6, and the circuit board 8 are integrally molded using a non-conductive resin, and the rubber contact 7 is integrally molded using non-conductive rubber. In following description, the left side in FIGS. 4 and 5 is defined as a front side, and the right side in FIGS. 4 and 5 is defined as the rear side.

As shown in FIG. 2, engagement claws 2*a* are integrally provided to protrude from four places of the outer periphery of a front end of a cylindrical main body 2A of the holder 2, and rectangular engagement holes 2*b* are formed at four places of the outer periphery of a rear end of the main body 2A (only the two holes are shown in FIG. 2). The main body 2A of the holder 2 has a dual-cylinder structure in which a duct-like rectangular guide tube 2B is formed at the axial center along the forward and rearward direction, and lens fixing parts 2C and 2D as curved faces are integrally formed along the forward and rearward direction above and below the guide tube, respectively. Here, guide grooves 2*c* are formed in right, left, and lower faces of the guide tube 2B along the forward and rearward direction.

As shown in FIG. 2 and FIGS. 6(*a*) and 6(*b*), a plurality of ribs 2*d* extending in the forward and rearward direction are formed between the main body 2A of the holder 2 and the upper lens fixing part 2C to form three duct-like rectangular lens accommodation parts 2*e* extending in the forward and rearward direction, and the lens accommodation parts 2*e* accommodated respective indicator lenses 9 as light transparent guide members that are long in the forward and rearward direction (See FIG. 4 and FIGS. 6(*a*) and 6(*b*)).

As shown in FIG. 2 and FIG. 4, a cylindrical closed-end cover 10 having a rectangular cutout hole 10*a* (See FIG. 2) is attached to an opening of the rear end of the holder 2, and a prismatic closed-end connector 11 is inserted and held in the cutout hole 10*a* formed in the lower portion of the cover 10. Here, as shown in FIG. 2, engagement protrusions 10*b* are protrudingly provided at four places (corresponding to the engagement holes 2*b* of the holder 2) of the outer periphery of the cover 10 (only the three protrusions are shown in FIG. 2) so as to be integral with the cover 10, and notched engagement holes 10*c* are formed in the left and right sides of the cover 10.

As described above, the connector 11 is positioned with respect to the cover 10 by fitting engagement protrusions 11*a* protruding from the left and right sides of the connector 11 (corresponding to the left and right engagement holes 10*c* of the cover 10) into the engagement holes 10*c* formed in both sides of the cover 10 from the front, and is inserted and held in the cover as shown in FIG. 4. Then, as shown in FIG. 4, by fitting the cover 10, in which the connector 11 is inserted and held, into the inner periphery of the rear end of the main body 2A of the holder 2, and engaging the four engagement protrusions 10*b* protruding from the outer periphery with the four the engagement holes 2*b* formed in the outer periphery of the rear end of the main body 2A of the holder 2, the cover 10 is attached to the holder 2 to cover the opening of the rear end of the holder 2. In this embodiment, the cover 10 and the connector 11 are integrally molded using a non-conductive resin, and eleven metal connection terminals 12 are horizontally inserted into and supported by the connector 11 as shown in FIG. 2.

As shown in FIG. 4 and FIG. 5, the rubber contact 7 and the circuit board 8, which are bonded to each other, are accommodated between the rear ends of the guide tube 2B and the lens fixing parts 2C and 2D and the front end of the cover 10, in the vicinity of the rear end of the holder 2.

As shown in FIG. 7 in detail, the circuit board 8 is substantially in the form of a disc, and three LEDs 13 as light sources are provided at three places of the circuit board 8 in the upper position in the widthwise center of its front surface (corresponding to the lens accommodation parts 2*e* of the holder 2 and the indicator lenses 9 accommodated in the lens accommodation parts 2*e*), one LED 14 as a light source is disposed at the center of the circuit board 8, and four LEDs 15 as light sources are disposed around the LED 14. Fixed contacts 16 (detection means) are disposed on left and right sides of the LED 14 on the circuit board 8, and two left and right insertion holes 8*a* are formed above the LED 14. Insertion holes 8*b* are formed at eleven places on the left, right, and lower sides of the circuit board 8 (corresponding to the eleven connection terminals 12 on the connector 11), and as shown in FIG. 4, the eleven connection terminals 12 on the connector 11 are inserted into the respective insertion holes 8*b* and are electrically connected to a wire (wiring pattern) not shown formed on the circuit board 8.

Thin bag-like rectangular translucent parts 7*a* protrude from three circumferential places (corresponding to the LEDs 13 on the circuit board 8) of the upper portion of the rubber contact 7, and a laterally-long through hole 7*b* is formed below the translucent parts 7*a*. A thin bag-like rectangular translucent part 7*c* protrudes from the center of the rubber contact 7, which corresponds to the LED 14, and switch parts 17 as detection means are formed on left and right sides of the translucent part 7*c* (corresponding to the two left and right fixed contacts 16 on the circuit board 8). Thin bag-like rectangular translucent parts 7*d* for transmitting light from the LEDs 15 are protrudingly provided around the switch parts 17 (four places corresponding to the four LEDs 15 on the circuit board 8). In order to prevent interference with the connection terminals 12 on the connector 11, bag-like rectangular convex parts 7*e* and 7*f* are protrudingly provided in the lower portion and both sides of the rubber contact 7, respectively.

The left and right switch parts 17 provided on the rubber contact 7 are in the form of a dome, and have respective movable contacts not shown. When the switch parts 17 are pressed to bring the movable contacts not shown into contact with the fixed contacts 16 on the circuit board 8 as described later, the contacts are brought into conduction, turning on the switch parts 17.

The slider 5 is a member accommodated so as to be movable forward and rearward along the guide tube 2B of the holder 2, and as shown in FIG. 2, guide rails 5*a* protrude from three places of left, right, and lower sides of the inner periphery of the slider 5 (corresponding to the three guide grooves 2*c* of the guide tube 2B) in the longitudinal direction (forward and rearward direction) so as to be integral with the slider 5. Engagement protrusions 5*b* are formed on left and right sides of the front end of the slider 5, and engagement protrusions 5*c* are formed on left and right sides of the rear end of the slider 5. As shown in FIG. 2, a through hole 5*d* opened to the front, left, and right is formed on the upper portion of the slider 5. As shown in FIG. 4 and FIG. 5, the guide tube 2B of the holder 2 is inserted into the slider 5, and the guide tube 2 and the slider 5 constitute a light guide path for guiding light from the LED 14 on the circuit board 8 to the operation knob 3 ahead of the LED 14.

As shown in FIG. 4 and FIG. 5, the second slider 6 is attached to the rear end of the slider 5. The second slider 6 is integrally molded into a rectangular frame using a resin as shown in FIG. 7 in detail, and rectangular engagement holes 6*a* are formed in both sides (corresponding to the engagement protrusions 5*c* of the slider 5). A cylindrical boss 6A and a switch operation part 6B are integrally formed on each of left and right sides of the rear end of the second slider 6, and stop rubbers 18 shown in FIG. 2 are inserted into and fixed at respective circular holes 6*b* formed in the two left and right bosses 6A (See FIG. 4). The two left and right switch operation part 6B are in contact with the left and right switch parts 17 on the rubber contact 7 (See FIG. 2).

By engaging the left and right engagement holes 6*a* with the left and right engagement protrusions 5*c* at the rear end of the slider 5, the second slider 6 is fixed to the rear end of the slider 5 as shown in FIG. 4 and FIG. 5.

The lens member 4 is integrally molded using a transparent optically-transparent resin, and as shown in FIG. 8 to FIG. 10 in detail, includes a flat and non-circular first ring part 4A that accommodates a coil antenna 19 and a cylindrical second ring part 4B that illuminates the outer periphery of the operation knob 3 in a ring form on the front face on which the operation knob 3 is disposed, and a cylindrical tapered light guide part 4C opposed to the LEDs 15 is formed in the rear of the second ring part 4B. A center (gravity center) axis C1 of the first ring part 4A is offset from a center axis C2 of the second ring part 4B in the vertical downward direction (See FIG. 9). A plurality of slits 4*a* are formed at multiple circumferential places of the light guide part 4C in the forward and rearward direction.

The coil antenna 19 serves to transmit starting radio waves for activating external mobile equipment held by the driver, and is formed by winding an antenna wire 19*a* (See FIG. 8) around a groove 20*a* (See FIG. 10) formed on the outer periphery of an antenna holder 20 of the same shape as the coil antenna. Two left and right metal connection terminals 21 horizontally extend rearward from left and right sides of the upper portion of the antenna holder 20, and ends of the antenna wire 19*a* are connected to one ends of the connection terminals 21.

In this embodiment, the antenna holder 20 holding the coil antenna 19 is incorporated into the first ring part 4A of the lens member 4 at manufacturing of the lens member 4. The lens member 4 in which the antenna holder 20 and the coil antenna 19 held by the antenna holder 20 are incorporated into the first ring part 4A is fixed in the holder 2 as shown in FIG. 4 and FIG. 5. Part (flat part) of the first ring part 4A penetrates the through hole 5*d* formed in the upper portion of the slider 5. In the state where the lens member 4 is assembled in the holder 2 in this manner, as shown in FIG. 6(*a*), a center axis C3 of the coil antenna 19 shaped like a flat ring and the antenna holder 20 holding the coil antenna 19 is offset from an operating center axis C4 of the operation knob 3 in the vertical downward direction, and part thereof penetrates the through hole 5*d* in the slider 5 as described above. Describing in more detail, one side (flat upper side in FIGS. 6(*a*) and 6(*b*)) of the outer periphery of the coil antenna 19 in the radial direction is located on the inner side of the outer periphery of the operation knob 3, and the other side (arc-like lower side in FIGS. 6(*a*) and 6(*b*)) of the outer periphery of the coil antenna 19 is located on the outer side of the outer periphery of the operation knob 3. The coil antenna 19 and the antenna holder 20 partially penetrate the through hole 5*d* in the slider 5 to allow forward and rearward movement of the slider 5, and the operation knob 3 and the second slider 6 that are fixed to the slider 5.

In the state where the lens member 4 is incorporated in the holder 2, the two left and right connection terminals 21 horizontally extending rearward from the antenna holder 20 pass through the through hole 7*b* (See FIG. 4 and FIG. 7) in the rubber contact 7 and are inserted into the two left and right insertion holes 8*a* in the circuit board 8. Consequently, the coil antenna 19 is electrically connected to the circuit board 8 via the two left and right connection terminals 21.

The disc-like operation knob 3 is fixed to the front end of the slider 5, and they slide with the second slider 6 in the holder 2 in the forward and rearward direction. Here, as shown in FIG. 2, engagement pieces 3A horizontally protrude rearward from two left and right places of the outer periphery of the operation knob 3 (only one piece is shown in FIG. 2), and the engagement pieces 3A have respective rectangular engagement holes 3*a*. Further, as shown in FIG. 1, a character display "ENGINE START STOP" (display) is made on the face of the operation knob 3.

The operation knob 3 is attached to the outer periphery of the front end of the slider 5 by fitting the left and right engagement pieces 3A to the outer periphery of the front end of the slider 5 and engaging the two left and right engagement protrusions 5*b* protruding from the outer periphery of the front end of the slider 5 with the engagement holes 3*a* in the engagement pieces 3A. In the state where the three guide rails 5*a* formed on the outer periphery of the slider 5 are aligned with the three guide grooves 2*c* in the inner periphery of the guide tube 2B of the holder 2, by fitting the slider 5 and the second slider 6 fixed thereto into the holder 2 from the front, the operation knob 3 and the slider 5 thus assembled are held so as to be movable forward and rearward along with the second slider 6 along the guide grooves 2*c* of the guide tube 2B. In this embodiment, as shown in FIG. 4 and FIG. 5, operation knob 3 and the slider 5 are disposed in a center hole of the lens member 4.

When the operation knob 3 is fitted and fixed to the slider 5 and accommodated in the holder 2 as described above, as shown in FIG. 1 to FIG. 5, a knob ring 22 as a transparent resin mold is fitted to the outer periphery of the operation knob 3, and a ring-like resin bezel 23 is fitted and fixed to the outer periphery of the knob ring 22 using a resin. The outer periphery of the bezel 23 is covered with a ring-like bezel cover 24 fixedly fitted to the outer periphery of the front end of the holder 2. The bezel cover 24 is integrally molded into a ring using a non-conductive resin, and rectangular engagement holes 24*a* are formed at four places of the outer periphery (corresponding to the four engagement claws 2*a* of the holder 2) (only the two holes are shown in FIG. 2). Accordingly, the bezel cover 24 is fixed to the outer periphery of the front end of the holder 2 by fitting the bezel cover 24 to the outer periphery of the front end of the holder 2, and engaging the four engagement claws 2*a* protruding from the outer periphery of the front end of the holder 2 with the four engagement holes 24*a* in the bezel cover 24.

Alphabets of "OFF", "ACC", and ON are displayed at three circumferential places of the upper portion of the bezel 23 (corresponding to the three lens accommodation parts 2*e* of the holder 2 and the indicator lenses 9 accommodated therein (See FIG. 6(*b*)).

Next, the action of the switch device 1 in accordance with this embodiment as an engine start/stop switch thus configured will be described.

While the driver does not operate the operation knob 3, the switch device 1 is in a non-operating state. In this state, the pair of left and right switch operation parts 6B provided at the rear end of the second slider 6 that slides integrally with the operation knob 3 do not press the switch parts 17 on the rubber contact 7, and movable contacts not shown on the switch parts 17 are not in contact with the fixed contacts 16 on the circuit board 8, so that the contacts are in a non-conductive state, turning off the switch parts 17.

When the driver presses the operation knob 3 in this state without pressing on a brake pedal, the operation knob 3 slides rearward together with the slider 5 and the second slider 6 fixed thereto, and the pair of left and right switch operation parts 6B formed at the rear end of the second slider 6 push the switch parts 17 on the rubber contact 7, bringing the movable contacts of the switch parts 17 into contact with the fixed contacts 16 on the circuit board 8, so that the contacts are brought into conduction and the two switch parts 17 are simultaneously turned on to energize and activate additional equipment (accessories) such as a radio and a CD. On the other hand, when the driver presses the operation knob 3 while pressing on the brake pedal, the switch parts 17 on the rubber contact 7 are also pressed, bringing the movable contacts into contact with the fixed contacts 16 on the circuit board 8, and the contacts are brought into conduction to turn on the switch parts 17.

When the driver presses the operation knob 3 as described above, the LEDs 13 on the circuit board 8 are selectively activated in response to the operation, and light emitted from one of the LEDs transmits through one of the translucent parts 7*a*, 7*c*, and 7*d* of the rubber contact 7 and then, passes through the indicator lens 9 and moves forward, lighting the word "OFF", "ACC", or "ON" displayed on the bezel 23, which indicates which operation the driver performs.

At night and in the similar situations, the LED 13 on the circuit board 8 is activated, and illumination light emitted from the LED 13 passes through the light guide path in the holder 2 and reaches the operation knob 3 in front of the LED to light the display "ENGINE START STOP" on the operation knob 3. Further, the LEDs 15 on the circuit board 8 are activated, and light emitted from the LEDs 15 is guided through the light guide part 4C of the lens member 4 into the lens member 4 and reflected inside the lens member 4, and is diffused. The light guided into the lens member 4 illuminates the transparent lens member 4 itself, and the light from the lens member 4 transmits through the transparent knob ring 22 and is emitted to the outside. As a result, at night and in the similar situations, the periphery of the operation knob 3 is illuminated like a ring.

When the driver presses the operation knob 3 while pressing on the brake pedal and the two switch parts 17 on the circuit board 8 are simultaneously turned on as described above, during stop of the engine, the vehicle authentication device transmits a request signal from an antenna part of a transceiver disposed in a vehicle compartment not shown to the vehicle compartment. Then, a transceiver part in mobile equipment not shown held by the driver receives the request signal, and sends an ID signal to the vehicle authentication device.

Next, the vehicle authentication device compares an ID code included in the ID signal received from the coil antenna 19 with a previously stored ID code. If the ID codes matches with each other, the ID code is authenticated, and the engine is stated. If the engine is already started, when the two switch parts 17 of the switch device 1 are simultaneously turned on, the engine is stopped.

Then, when the driver moves his/her hand off the operation knob 3 of the switch device 1, the operation knob 3 is returned to an original non-operating position as shown in FIG. 4 and FIG. 5 by the elastic restoring force of the switch parts 17 on the rubber contact 7 and the stop rubbers 18, and the switch operation parts 6B of the second slider 6 are separated from the switch parts 17 on the rubber contact 7, turning off the switch parts 17. The stop rubbers 18 contact the holder 2 when the operation knob 3 returns to the original non-operating position, preventing the occurrence of a tapping sound.

As described above, with the switch device 1 in accordance with this embodiment, because the coil antenna 19 is integrated with the optically transparent lens member 4 via the antenna holder 20, the opaque part caused by the coil antenna 19 can be reduced, suppressing the influence on ring illumination through the knob ring 22 for lighting the outer periphery of the operation knob 3. This can achieve ring illumination of the rim of the operation knob 3 without increasing the size of the switch device 1.

With the switch device 1 according to the present invention, to prevent interference between the slider 5, and the coil antenna 19 and the antenna holder 20 to allow forward and rearward movement of the slider 5, the through hole 5*d* is formed in the slider 5, and the coil antenna 19 and the antenna holder 20 are partially inserted into the through hole 5*d*. Such effective use of the through hole 5*d* as a dead space enables strategic arrangement of the coil antenna 19 and the antenna holder 20, making the switch device 1 compact.

Further, with the switch device 1 according to the present invention, the first ring part 4A can be offset from the second ring part 4B such that one side (lower side in FIGS. 6(*a*)and 6(*b*)) of the outer periphery of the first ring part 4A in the radial direction of the lens member 4, which requires a predetermined space, is located on the outer side of the outer periphery of the operation knob 3, ensuring a high degree of flexibility in illumination for the display on the operation knob 3 without increasing the outer dimension of the coil antenna 19. Especially, in this embodiment, because the center axis C3 of the coil antenna 19 is offset from the operating center axis C4 of the operation knob 3 in the vertical downward direction, the capability of communication between the coil antenna 19 and the mobile equipment can be improved in the case where the switch device 1 is provided in the upper portion of the instrument panel, or the user operates the operation knob 3 while holding a card-type mobile equipment.

Although the center axis C3 of the coil antenna 19 is offset from the operational center line C4 of the operation knob 3 in the vertical downward direction in the embodiment, the coil antenna 19 may be offset upward, or to left or right. For example, when the switch device 1 is provided in the lower portion of the instrument panel, since the mobile equipment is put over the switch device 1, so that when the center axis C3 of the coil antenna 19 is offset from the operational center line C4 of the operation knob 3 in the vertical upward direction, the capability of communication between the coil antenna 19 and the mobile equipment is improved.

Further, although the coil antenna 19 and the antenna holder 20 holding the coil antenna 19 are shaped like a flat noncircular ring in the embodiment, the coil antenna 19 and the antenna holder 20 may be elliptical or shaped like a perfect circle ring. Also in these cases, the center axis C3 may be offset from or coaxial with the operational center line C4 of the operation knob 3, achieving the same effect.

The present invention applies to the switch device as the engine start/stop switch in the above description. As a matter of course, however, the present invention can also apply to any other switch devices having similar configurations.

DESCRIPTION OF SYMBOLS

1: Switch device
2: Holder
2A: Main body of holder
2B: Guide tube of holder
2C, 2D: Lens fixing part of holder
2*a*: Engagement claw of holder
2*b*: Engagement hole of holder
2*c*: Guide groove of holder
2*d*: Rib of holder
2*e*: Lens accommodation part of holder
3: Operation knob
3A: Engagement piece of operation knob
3*a*: Engagement hole of operation knob
4: Lens member
4A: First ring part of lens member
4B: Second ring part of lens member
4C: Light guide part of lens member
4*a*: Slit of lens member
5: Slider
5*a*: Guide rail of slider
5*b*, 5*c*: Engagement protrusion of slider
5*c*: Lens accommodation part of slider
5*d*: Through hole of slider
6: Second slider
6A: Boss of second slider
6B: Switch operation part of second slider
6*a*: Engagement hole of second slider
6*b*: Circular hole of second slider
7: Rubber contact
7*a*: Translucent part of rubber contact
7*b*: Through hole of rubber contact
7*c*, 7*d*: Translucent part of rubber contact
7*e*, 7*f*: Convex part of rubber contact
8: Circuit board
8*a*, 8*b* Insertion hole of circuit board
9: Indicator lens
10: Cover
10*a*: Cutout hole of cover
10*b*: Engagement protrusion of cover
10*c*: Engagement hole of cover
11: Connector
11*a*: Engagement protrusion of connector
12: Connection terminal
13-15: LED (light source)
16: Fixed contact (detection means)
17: Switch part (detection means)
18: Stop rubber
19: Coil antenna
19*a*: Antenna wire
20: Antenna holder
20*a*: Groove of antenna holder
21: Connection terminal
22: Knob ring
23: Bezel
24: Bezel cover
24*a*: Engagement hole of bezel cover

The invention claimed is:

1. A switch device comprising:

a holder;

an operation knob with a display, the operation knob held in the holder so as to be movable forward and rearward;

a ring-like coil antenna that transmits starting radio waves for activating external mobile equipment;

a circuit board on which a wire for connecting the coil antenna to an external electric circuit and a detection means for detecting an operation of the operation knob are disposed;

a light source for illuminating the display on the operation knob disposed on the circuit board;

an optically transparent lens member disposed on an outer periphery of the operation knob and transmitting a light from the light source so as to illuminate the outer periphery of the operation knob; and a slider accommodated in the holder so as to be movable forward and rearward integrally with the operation knob and having a light guide path for the light source, wherein the coil antenna is integral with the lens member, wherein the operation knob and the slider are disposed in a center hole of the lens member, wherein a first ring part that accommodates the coil antenna and a second ring part that illuminates the outer periphery of the operation knob in a ring form are formed on a front face side of the lens member where the operation knob is disposed, and wherein a cylindrical light guide part opposed to the light source is formed on a rear face side of the lens member.

2. The switch device according to claim 1, wherein a center axis of the first ring part of the lens member is offset from a center axis of the second ring part in the vertical direction, wherein the slider has a through hole into which the first ring part of the lens member is partially inserted, and wherein a center axis of the coil antenna is offset from an operating center axis of the operation knob in the vertical direction.

3. The switch device according to claim 2, wherein one side of an outer periphery of the first ring part of the lens member in the radial direction is disposed on an outer side of an outer periphery of the operation knob, and wherein the other side of the outer periphery of the first ring part is disposed on an inner side of the outer periphery of the operation knob.

* * * * *